US009616317B2

(12) United States Patent
Neubauer et al.

(10) Patent No.: US 9,616,317 B2
(45) Date of Patent: Apr. 11, 2017

(54) COLLAPSIBLE POLE ASSEMBLY

(71) Applicant: K-2 Corporation, Seattle, WA (US)

(72) Inventors: Jason Neubauer, Redmond, WA (US); Lai Hsin Yuan, Taichung (TW)

(73) Assignee: K-2 Corporation, Seattle, WA (US)

( * ) Notice: Subject to any disclaimer, the term of this patent is extended or adjusted under 35 U.S.C. 154(b) by 171 days.

(21) Appl. No.: 13/663,153

(22) Filed: Oct. 29, 2012

(65) Prior Publication Data

US 2013/0291914 A1 Nov. 7, 2013

Related U.S. Application Data

(60) Provisional application No. 61/553,070, filed on Oct. 28, 2011.

(51) Int. Cl.
*A45B 9/00* (2006.01)
*A63C 11/22* (2006.01)

(52) U.S. Cl.
CPC ..... *A63C 11/221* (2013.01); *A45B 9/00* (2013.01)

(58) Field of Classification Search
CPC . A63C 11/221; A63C 11/22; A45B 2009/007; A45B 19/04; A45B 3/12; A45B 9/00
USPC .... 135/65, 69, 75; 280/819, 823; 403/109.1, 403/109, 109.3
See application file for complete search history.

(56) References Cited

U.S. PATENT DOCUMENTS 1,336,844 A * 4/1920 Klousnitzer ..... 135/82
2,888,022 A * 5/1959 Fanning ..... 135/82
3,658,076 A * 4/1972 Yasuda ..... 135/22
3,987,807 A * 10/1976 Varnell ..... 135/66
4,869,280 A * 9/1989 Ewing ..... 135/69
6,273,112 B1 * 8/2001 Sumida ..... A45B 9/00 135/69
7,302,745 B2 * 12/2007 Stahle ..... A47L 9/244 29/434

(Continued)

FOREIGN PATENT DOCUMENTS

DE 1 678 256 10/1972
DE 202 11 381 U1 1/2004

(Continued)

OTHER PUBLICATIONS

Extended European Search Report mailed Feb. 26, 2013, issued in corresponding European Application No. EP 12 190 352.0, filed Oct. 29, 2012, 8 pages.

(Continued)

*Primary Examiner* — Winnie Yip
(74) *Attorney, Agent, or Firm* — Husch Blackwell LLP

(57) ABSTRACT

A releasable lock assembly for use with a collapsible pole assembly having a first shaft section slidably secured to a second shaft section includes a locking mechanism configured to selectively lock the first and second shaft sections in an extended position. The releasable lock assembly further includes a stop assembly having an elongated member having first and second ends, wherein the first end is secured to one of the first and second shaft sections and the second end secured to the other of the first and second shaft sections. The stop assembly further comprises a stop assembly biasing member configured to urge the first and second shaft sections into a collapsed position.

10 Claims, 11 Drawing Sheets

(56) References Cited

U.S. PATENT DOCUMENTS

| | | | | |
|---|---|---|---|---|
| 8,499,776 | B2 * | 8/2013 | Ban | 135/75 |
| 2002/0170587 | A1 * | 11/2002 | Uemura | A45B 9/00 135/65 |
| 2006/0090783 | A1 * | 5/2006 | King-Fai | 135/67 |
| 2007/0108756 | A1 * | 5/2007 | Laakso et al. | 280/823 |
| 2010/0170548 | A1 * | 7/2010 | Lenhart | A45B 9/00 135/75 |
| 2010/0200032 | A1 * | 8/2010 | Lee | 135/74 |
| 2010/0254751 | A1 * | 10/2010 | McMillan, III | 403/109.1 |
| 2012/0288326 | A1 * | 11/2012 | Lah | 403/378 |
| 2013/0312797 | A1 * | 11/2013 | Lah | 135/74 |
| 2014/0069475 | A1 * | 3/2014 | Lenhart | 135/74 |

FOREIGN PATENT DOCUMENTS

| | | | | |
|---|---|---|---|---|
| DE | 20 2010 006 677 | U1 | | 10/2011 |
| FR | 2 475 911 | | | 8/1981 |
| JP | S56130171 | A | | 10/1981 |
| JP | 2007014395 | A | * | 1/2007 |
| WO | 2009/154467 | A1 | | 12/2009 |
| WO | 2010/085905 | A1 | | 8/2010 |

OTHER PUBLICATIONS

Examination Report mailed Oct. 12, 2015, issued in corresponding European Patent Application No. 12 190 352.0, filed Oct. 29, 2012, 4 pages.

Notice of Reasons for Refusal mailed Jul. 21, 2016, issued in corresponding Japanese Patent Application No. 2012-237575, filed Oct. 29, 2012, with Machine Translation, 8 pages.

* cited by examiner

COLLAPSIBLE POLE ASSEMBLY

CROSS-REFERENCE TO RELATED APPLICATION

This application claims the benefit of U.S. Provisional Application No. 61/553,070, filed Oct. 28, 2011, the disclosure of which is hereby expressly incorporated by reference.

BACKGROUND

When making a collapsible ski pole or trekking pole with the goal of minimum size possible in the collapsed mode, one solution is to have multiple telescopic shafts that slide inside each other completely. A design challenge is determining how to secure the individual shafts rigidly in both directions when the pole assembly is in the extended mode.

The shaft sections may be secured in the extended mode with a locking pin that extends through overlapping inner and outer shafts. There are two main locking pins designs for securing shafts in both directions (both directions meaning extending or collapsing).

Referring to FIGS. 1A and 1B, the first design is the "pin through the outer shaft design." The outer shaft on top includes a series of holes, and the inner shaft below includes a spring pin that is receivable within one of the holes. As shown in FIG. 1B, the inner shaft is received within the outer shaft, and the spring pin is disposed in one of the holes in the outer shaft. This design substantially secures the shafts rigidly in both directions.

One major issue with this prior art pin through the outer shaft design is that it requires that the shafts have some sort of non-round cross-sectional shape so the shafts cannot spin or rotate with respect to each other. If the shafts are instead round in cross-section, the orientation of the outer and inner shafts and holes will not stay aligned, and it is very difficult to find the correct location for the spring pin to push thru the outer shaft hole. A prior attempt to remedy this issue is to paint a longitudinal line on the inner shaft aligned with the spring pin. This way the user can attempt to align the shafts by sight using the guide line. This solution works but is not easy or quick to use.

The second issue with this prior art pin through the outer shaft design is that the two shafts are held together by only the pin, and the slop or play in the system is based on the diameter difference between the pin and the holes. There is a small amount of play required to allow the pin to pop thru the holes easily; and therefore, this system can have rattle issues.

Referring to FIG. 1C, the second design is the "pin below outer shaft design." This design includes an upper/outer shaft and a lower/inner shaft. The spring pin in the lower/inner shaft has popped out below the upper/outer shaft and therefore does not allow the upper shaft to slide down over the inner shaft when downward force is put on the pole. This design addresses the major issue with the above-described method of aligning a pin with a hole, as the pin just pops out below the upper/outer shaft, and no orientation is needed. However, the issue with this pin below outer shaft design is that nothing is holding the lower/inner shaft from upwardly extending further and even falling out of the upper/outer shaft.

Prior solutions to this issue have included using an internal cord, string or cable to hold the two shafts together and to prevent them from extending too far apart. However, with this cord solution, the cord must be either fixed in length or it must be made taut after each extension of the pole. If the cord is fixed in length, the expansion of the two shafts will be limited and defined by the length of the cord. If the cord is adjustable in length, the cord is loosened to allow the pole to be freely extended, and then once extended the cord is tightened to assure the spring pin is held firmly against the lower edge of the upper/outer shaft. When held tightly against the lower edge of the upper/outer shaft, there is substantially no rattling or play in the pole assembly and the pole will not overextend. However, loosening and tightening the cord with each extension or collapse of the pole assembly is very cumbersome and time consuming.

Another limitation of the adjustable cord solution is that it can only be adequately used between the expansion of two shafts. For instance, in a three-piece collapsible pole assembly having a first shaft with second and third shafts telescopingly received on the first shaft, the cord would extend between the first, second, and third shafts. The cord may not prevent one of the second and third shafts from extending beyond their expansion range before being stopped by the cord unless the second and third shafts were slowly extended simultaneously.

Thus, it can be appreciated that there is a need for an improved collapsible ski or trekking pole assembly that improves upon at least these above-described prior art designs.

SUMMARY

A releasable lock assembly for use with a collapsible pole assembly having a first shaft section slidably secured to a second shaft section includes a locking mechanism configured to selectively lock the first and second shaft sections in an extended position. The releasable lock assembly further includes a stop assembly having an elongated member having first and second ends, wherein the first end is secured to one of the first and second shaft sections and the second end secured to the other of the first and second shaft sections. The stop assembly further comprises a stop assembly biasing member configured to urge the first and second shaft sections into a collapsed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1A:
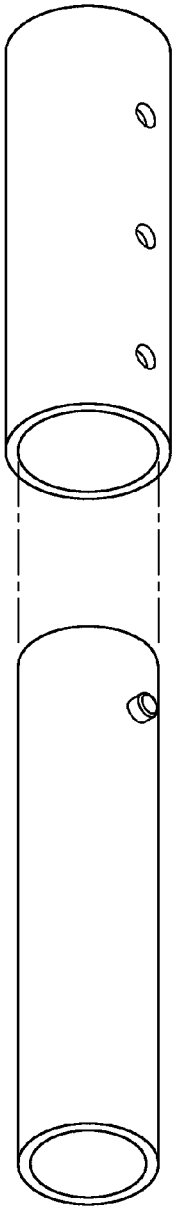
Fig. 1A. (PRIOR ART)
FIG. 1A is an isometric view of a collapsible pole assembly having a prior art pin through the outer shaft design, wherein the collapsible pole assembly is shown exploded.
Figure 1B:
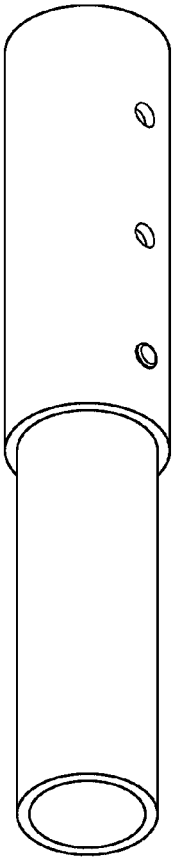
Fig. 1B. (PRIOR ART)
FIG. 1B is an isometric view of a collapsible pole assembly having a prior art pin through the outer shaft design, wherein the collapsible pole assembly is shown assembled.
Figure 1C:
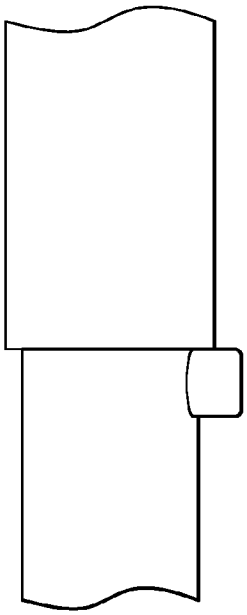
Fig. 1C. (PRIOR ART)
FIG. 1C is an isometric view of a collapsible pole assembly having a prior art pin below the outer shaft design.
Figure 2:
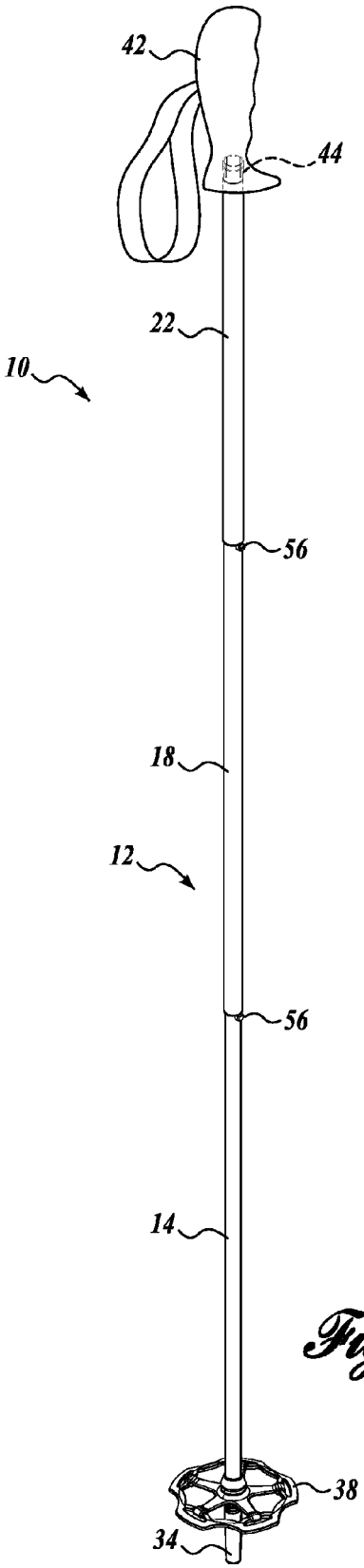
FIG. 2 is an isometric view of an exemplary collapsible pole assembly formed in accordance with a first aspect of the present disclosure; wherein the collapsible pole assembly is shown in an extended position.
Figure 3:
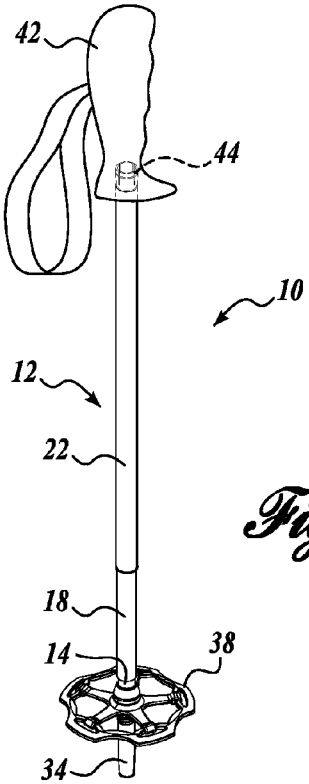
FIG. 3 is an isometric view of the collapsible pole assembly of FIG. 1 shown in a collapsed position.
Figure 4:
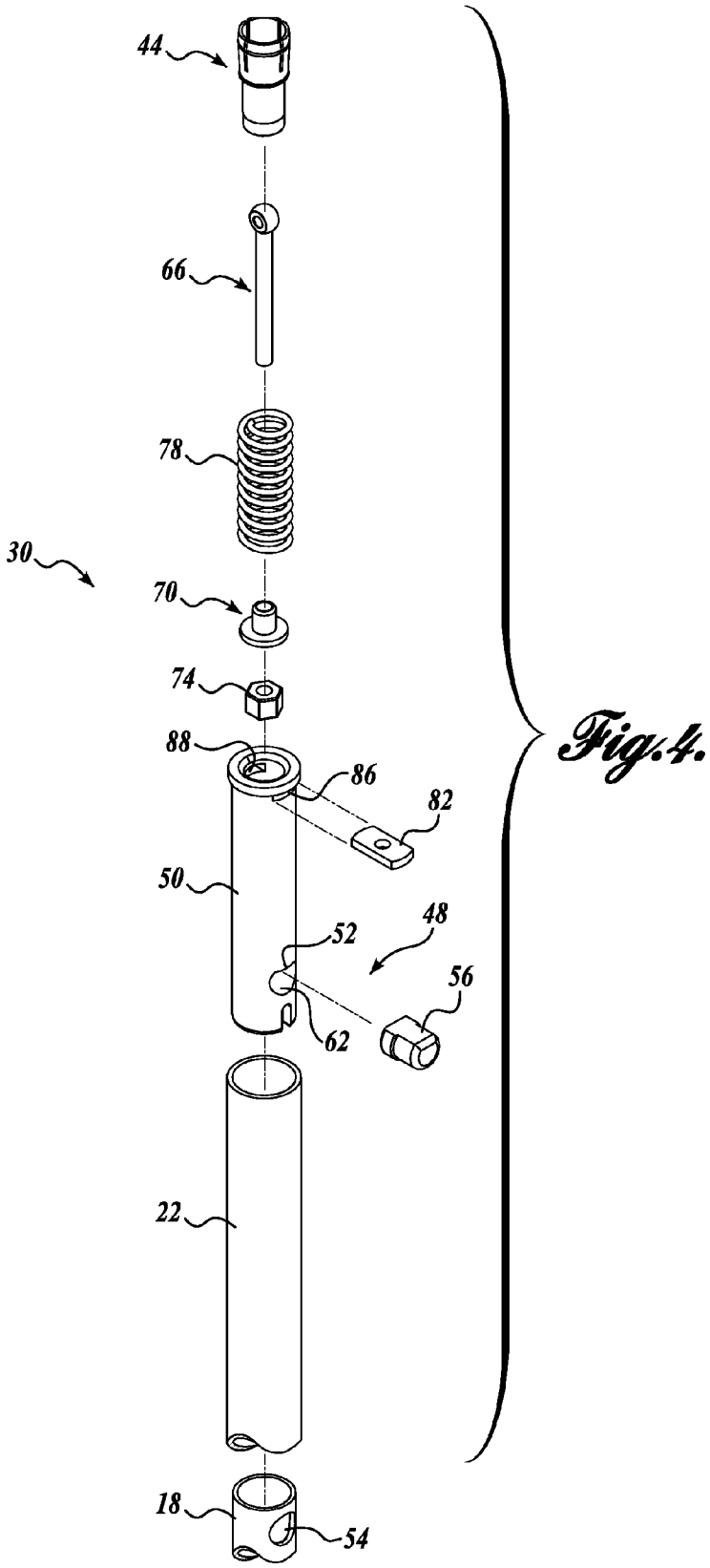
FIG. 4 is an isometric exploded view of a locking mechanism suitable for use with the collapsible pole assembly of FIG. 1, wherein the locking mechanism is configured to selectively secure the pole assembly in a locked and unlocked position.

A collapsible pole assembly 10, formed in accordance with a first embodiment of the present disclosure, may best be seen by referring to FIGS. 2-4. The collapsible pole assembly 10 includes a releasable lock assembly 30 that is configured to selectively lock the collapsible pole assembly 10 in an extended position such that the collapsible pole assembly 10 may be used for trekking, skiing, etc., as is well known in the art.

Referring first to FIGS. 2 and 3, an exemplary collapsible pole assembly 10 for use with the releasable lock assembly 30 will be described. The collapsible pole assembly 10 includes a shaft 12 defined by two or more telescoping shaft sections that may be moved between extended and collapsed positions, as shown in FIGS. 2 and 3, respectively. In the depicted embodiment, the shaft 12 includes a first shaft section 14 having a first shaft section diameter, a second shaft section 18 telescopingly received on the first shaft section 14 and having a second shaft diameter larger than the first shaft diameter, and a third shaft section 22 telescopingly received on the second shaft section 18 and having a third shaft diameter larger than the second shaft diameter. The first, second, and third shaft sections 14, 18, and 22, when extended, define the shaft 12 of the collapsible pole assembly 10 having a predetermined length. It should be appreciated that the first, second, and third shaft sections 14, 18, and 22 may be any suitable diameter and length, and may be made from any suitable material well known in the art, such as aluminum or carbon fiber.

A tip 34 may extend from the bottom end of the first shaft section 14 for engaging the ground or other surface. A basket 38, as is well known in the art, may be received on the shaft 12 between the first shaft section 14 and the tip 34, which can help prevent the shaft from sinking into snow or soft, muddy ground. A handle 42 extends from the top end of the third shaft section 22 that is suitably configured for gripping and using the collapsible pole assembly 10 when the shaft 12 is extended.

A handle-mounting device 44 may be received within the upper open end of the third shaft section 22 for suitable mounting of the handle 42 to the top end of the third shaft section 22. The handle-mounting device 44 may be any suitable configuration. For instance, the handle-mounting device 44 may be configured to be snap-fit within an opening in the bottom of the handle 42. In the alternative, the handle-mounting device 44 maybe integrally formed within the third shaft section 22. It should be appreciated that the foregoing description of the collapsible pole assembly 10 is exemplary only, and any suitable collapsible pole assembly design may instead be used.

Figure 5:
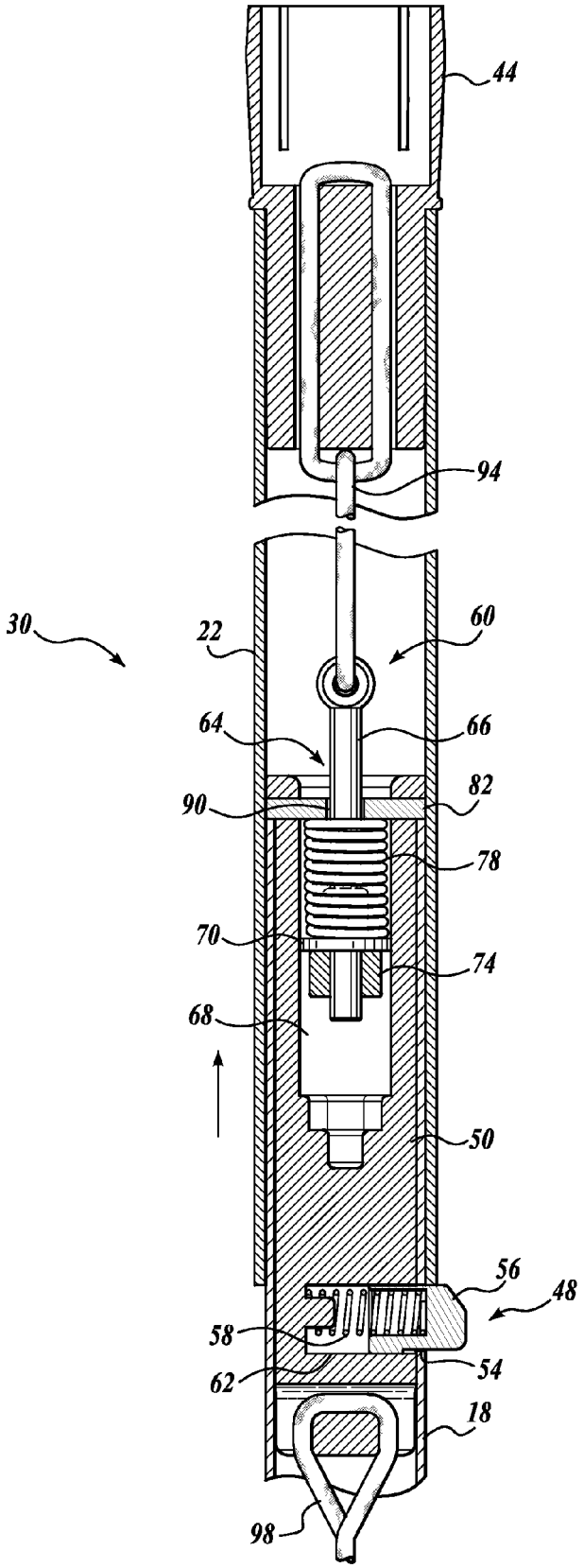
FIG. 5 is a cross-sectional view of the releasable lock assembly of FIG. 3 shown in a locked position.
Figure 6:
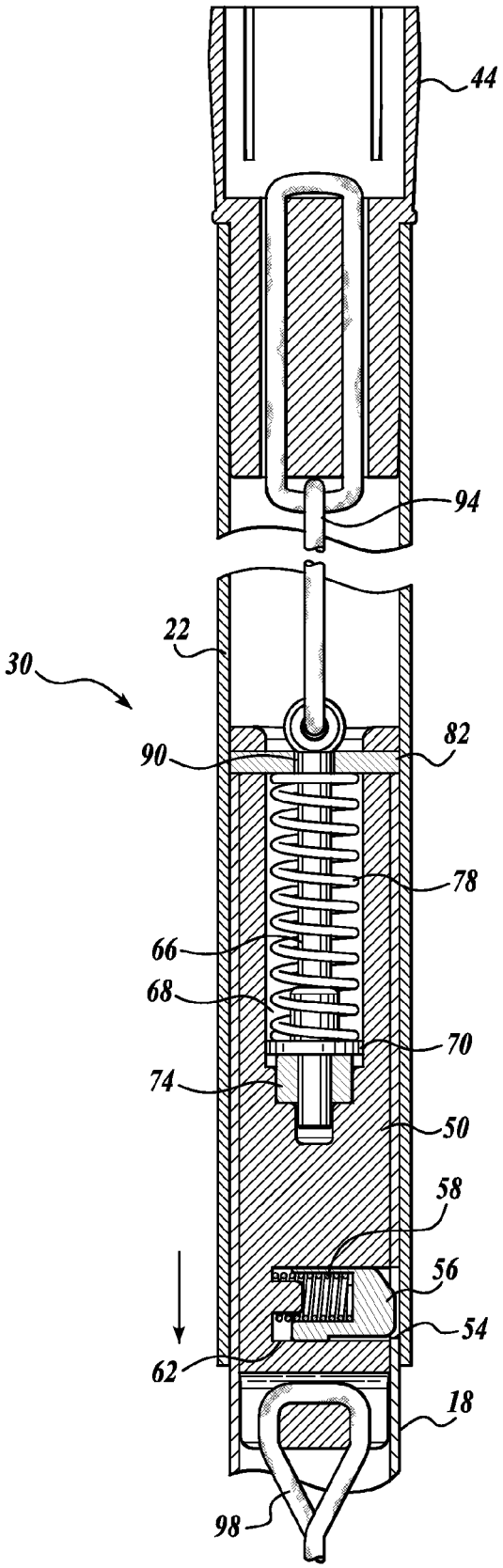
FIG. 6 is a cross-sectional view of the releasable lock assembly of FIG. 3 shown in an unlocked position.

Referring to FIGS. 4-6, the releasable lock assembly 30 for selectively securing the collapsible pole assembly 10 in the extended position will now be described in detail. In the FIGURES, the releasable lock assembly 30 is shown generally disposed between the second and third shaft sections 18 and 22. It should be appreciated that additional releasable lock assemblies 30 may be additionally disposed between the second and third shaft sections 18 and 22 and the first and second shaft sections 14 and 18.

The releasable lock assembly 30 includes a cylindrical shaft 50 having an outer diameter that is substantially equal to the inner diameter of the second shaft section 18 such that the cylindrical shaft 50 is press fit or otherwise received within the second shaft section 18. A locking mechanism, or detent mechanism 48 is defined within the cylindrical shaft 50 for selectively securing the third shaft section 22 in the extended position relative to the second shaft section 18. The detent mechanism 48 includes a transverse opening 58 in the cylindrical shaft 50 sized to receive a spring pin 56 therein. The opening 58 in the cylindrical shaft 50 is in communication with a cavity 62 having a depth to receive a biasing member, such as a compression spring 58 therein that is configured to urge the spring pin 56 outwardly from within the cavity 62.

The spring pin 56 is of a predetermined length such that it protrudes from the opening 58 in the cylindrical shaft 50 and an opening 54 in the second shaft section 18, and it engages the bottom edge of the third shaft section 22 when the third shaft section 22 is moved into an extended position, as shown in FIG. 5. In other words, the third shaft section 22 slides relative to the second shaft section 18 into the extended position until the spring pin 56 is urged outwardly into engagement with the bottom edge of the third shaft section 22. To allow the third shaft section 22 to collapse onto the second shaft section 18, the user depresses the spring pin 56 so that the third shaft section 22 may slide axially relative to the second shaft section 18, as shown in FIG. 6. Thus, the spring pin 56 temporarily prevents the third shaft section 22 from sliding axially relative to the second shaft section 18 into the collapsed position. It should be appreciated that any other suitable detent mechanism or other type of locking mechanism may instead be used.

The releasable lock assembly 30 further includes an expansion assembly 60 that prevents the third shaft section 22 from continuing to slide axially upwardly away from the second shaft section 18 when the third shaft section 22 is moved into the extended position, as shown in FIG. 5. The expansion assembly 60 includes a pin subassembly 64 slidably received within an axial pin cavity 68 defined within the interior of the upper end of the cylindrical shaft 50.

The pin subassembly 64 is defined by an elongated member, or pin 66 having a spring washer 70 received axially on the distal, lower end of the pin 66. The spring washer 70 is secured on the end of the pin 66 by a nut 74 or other fastener. A compression spring 78 is disposed axially on the pin 66 and extends between an upper end of the pin 66 and the spring washer 70.

The pin subassembly 64 is secured within the axial pin cavity 68 such that the pin 66 is slidable axially within the cavity 68. Although the pin 66 may be secured within the axial pin cavity 68 in any suitable manner, in the embodiment depicted, the pin 66 is secured within the cavity by passing a key 82 transversely through first and second slots 86 and 88 formed within the cylindrical shaft 50. The key 82 includes a pin opening 90 formed therein that allows the shaft of the pin 66 to pass therethrough. In this manner, and as can be seen in FIGS. 5 and 6, the compression spring 78 is retained between the key 82 and the washer 70.

It should be appreciated that the pin subassembly 64 may instead be configured to use an extension spring. In such an alternative embodiment, a first end of the extension spring could be mounted to the cylindrical shaft 50 or a portion of the second shaft section 18 and a second end of the extension spring secured to the pin 66. Thus, any suitable expansion assembly that holds the second and third shaft sections 18 and 22 together in tension may be used without departing from the scope of the present disclosure.

The upper end of the pin 66 (or the head, as depicted in the FIGURES) is secured to the handle-mounting device 44 through a non-elastic first cord 94 or similar device. The handle-mounting device 44, through the first cord 94, pulls axially upwardly on pin 66 when the second and third shaft sections 18 and 22 are extended. It should be appreciated that the pin 66 and cord 94 may instead be one integral elongated member unit.

Referring specifically to FIG. 5, when the pin 66 is pulled upwardly by the cord 94, the compression spring 78 compresses to hold the second and third shaft sections 18 and 22 together in tension. In that regard, the releasable lock assembly 30 may be configured such that the spring pin 56 does not pop out until the compression spring 78 of the pin subassembly 64 is at least partially compressed to hold the collapsible pole assembly in tension in the extended position. Moreover, with the second and third shaft sections 18 and 22 held together in tension, the second and third shaft sections 18 and 22 are urged into the collapsed position when the spring pin 56 is depressed, as shown in FIG. 6. It should be appreciated that the releasable lock assembly 30 may instead be configured such that the cord 94 is secured to the second shaft section 18 and the expansion assembly 60 is disposed within the third shaft section 22 (i.e., the releasable lock assembly 30 could be turned upside down).

A releasable lock assembly 30 may similarly be disposed between the first shaft section 14 and the second shaft section 18. In this manner, the first, second, and third shaft sections 14, 18, and 22 are held together in tension when they are moved into the extended position. In addition, the first, second, and third shaft sections 14, 18, and 22 are urged into the collapsed position when the spring pins 56 are depressed. Thus, it can be appreciated that the releasable lock assembly 30 may be used to secure an unlimited number of shaft sections together in tension when they are moved between extended and collapsed positions.

Figure 7:
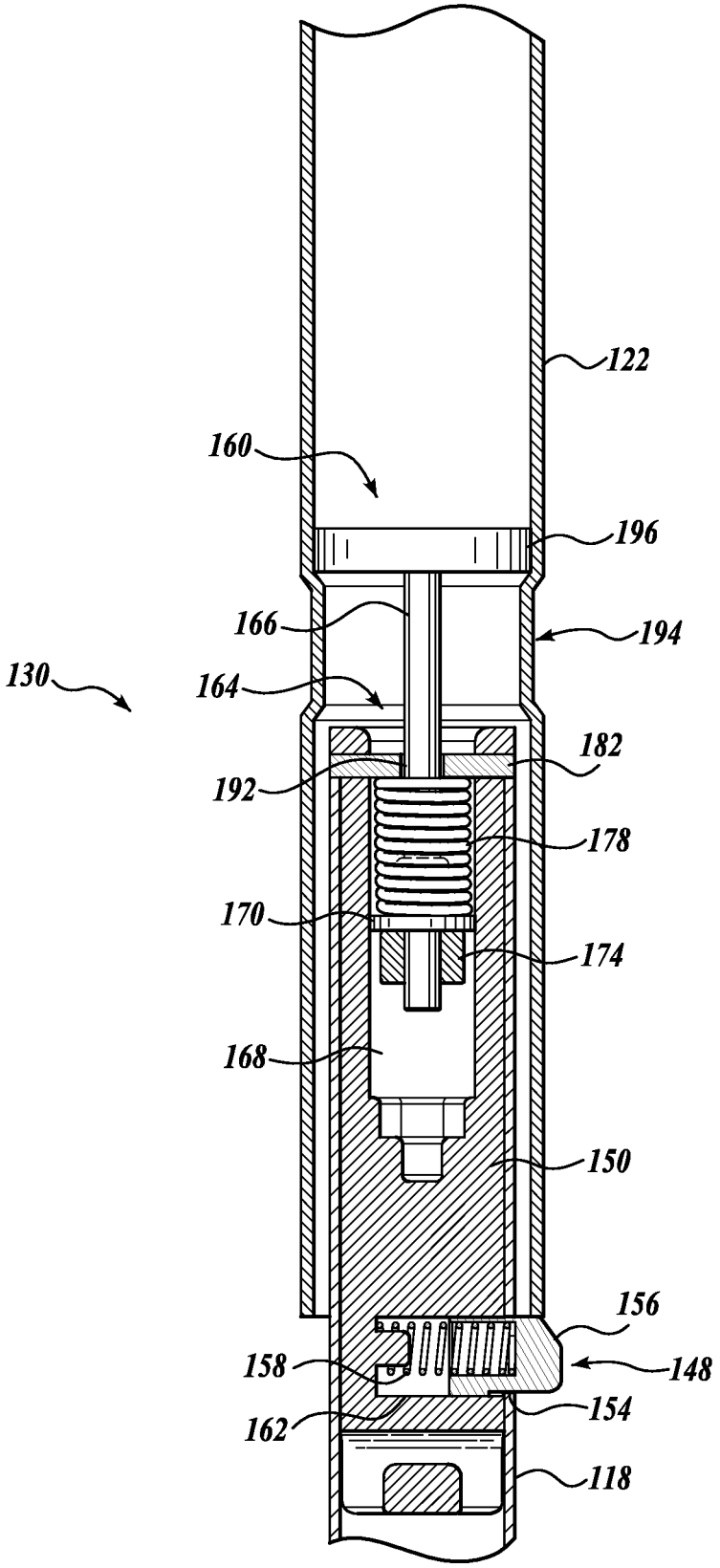
FIG. 7 is a cross-sectional view of an exemplary alternative embodiment of the expansion mechanism shown in a locked position.
Figure 8:
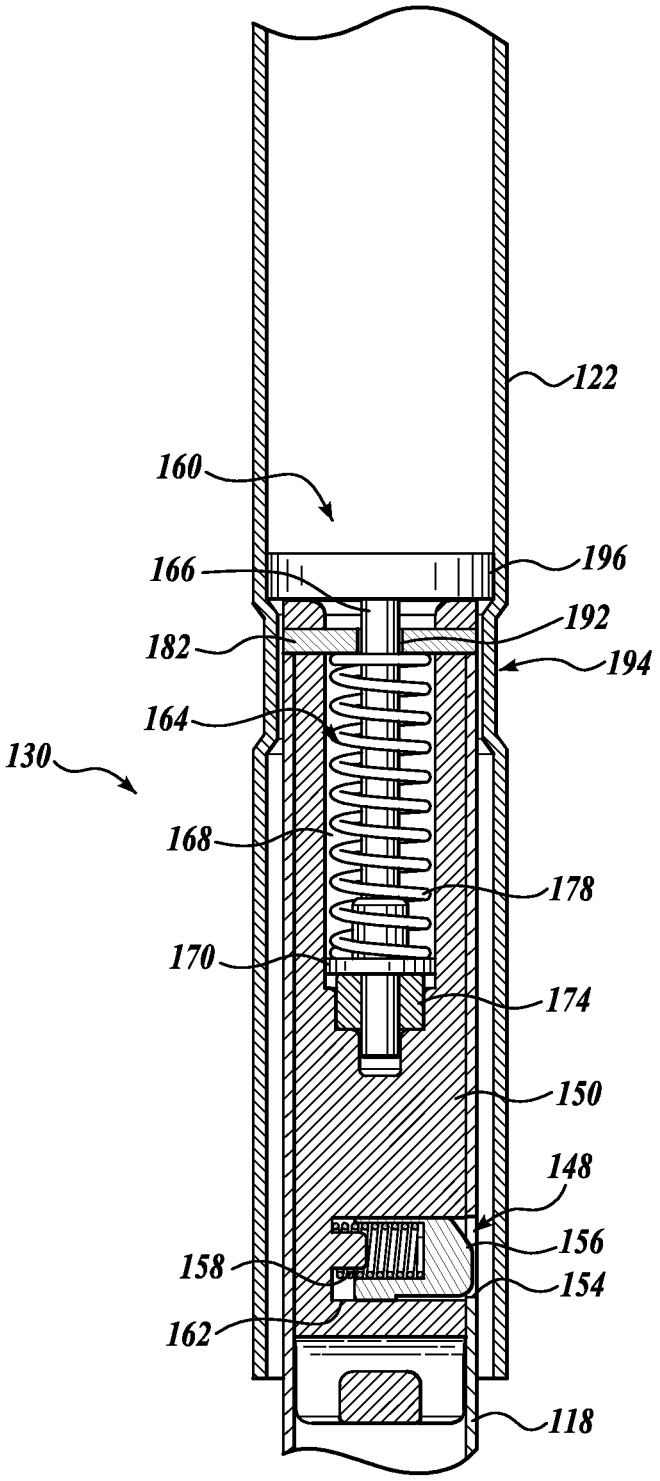
FIG. 8 is a cross-sectional view of the expansion mechanism of FIG. 6 shown in an unlocked position.

Referring to FIGS. 7 and 8, an alternate embodiment of a releasable lock assembly 30 for use with a second embodiment of a collapsible pole assembly (not depicted in its entirety) will now be described in detail. The releasable lock assembly 130 is substantially similar to the releasable lock assembly 30 described above except for the differences hereinafter provided. In that regard, like parts are numbered with like numerals in the 100 series for ease of reference.

The releasable lock assembly 130 includes an expansion assembly 160 having a pin subassembly 164 substantially identical to the pin subassembly 64 described above except that the pin 166 is secured at its upper distal end to an internal stop plate 196. The internal stop plate 196 is of a predetermined diameter such that it is engageable by an internal reduced diameter portion 192 of the third shaft section 122. In that regard, the third shaft section 122 may have an internal diameter greater in size that the external diameter of the second shaft section 118 such that a gap is defined between the second and third shaft sections 118 and 122. Moreover, the internal diameter of the reduced diameter portion 192 may be of substantially the same size or slightly larger than the external diameter of the second shaft section 118. In this manner, the reduced diameter portion 192 may slide relative to the second shaft section.

The reduced diameter portion 192 is formed within the third shaft section 122 such that the reduced diameter portion 192 engages and lifts the internal stop plate 196 when the third shaft section 122 is moved upwardly into the extended position, as shown in FIG. 7. When the internal stop plate 196 is lifted by the reduced diameter portion 192 the compression spring 178 compresses to hold the assembly in tension.

It should be appreciated that the reduced diameter portion may instead be embodied as any other suitable design. For example, the reduced diameter portion may be configured as ribs formed along the interior surface of the third shaft section 122, an inner sleeve formed on or otherwise attached to the interior surface of the third shaft section 122, etc. In these non-limiting examples, the ribs or sleeve would be engageable with and lift the internal stop plate 196 when the third shaft section 122 is moved upwardly into the extended position.

Referring to FIGS. 9-15, a collapsible pole assembly 210 formed in accordance with a third embodiment of the present disclosure is depicted. The collapsible pole assembly 210 is substantially identical to the collapsible pole assembly 10 described above. In that regard, the collapsible pole assembly 210 includes a shaft 212 having a first shaft section 214 with a first shaft section diameter, a second shaft section 218 telescopingly received on the first shaft section 214 and having a second shaft diameter larger than the first shaft diameter, and a third shaft section 222 telescopingly received on the second shaft section 18 and having a third shaft diameter larger than the second shaft diameter. A tip 34 and basket 38 extend from the lower end of the first shaft section 214, and a handle mounting device 44 and handle 42 extend from the upper end of the third shaft section 222.

Figure 15:
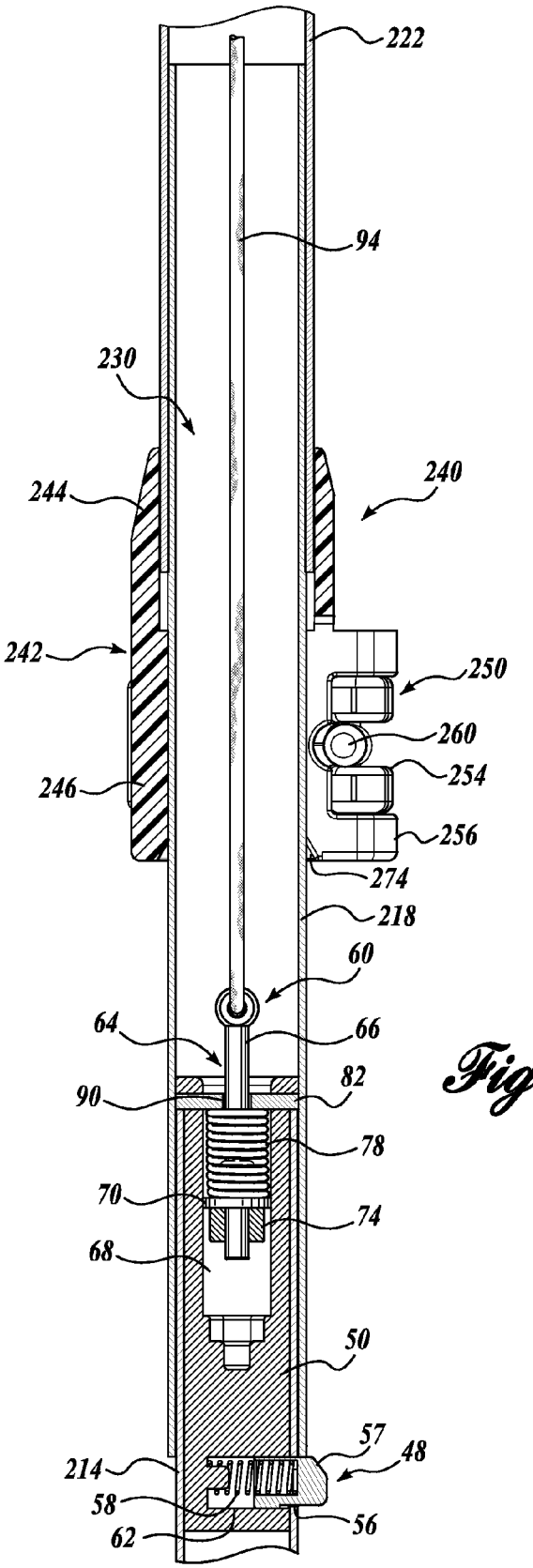
FIG. 15 is a cross-sectional view of a releasable lock assembly of the collapsible pole assembly of FIG. 9.

Referring specifically to FIG. 15, the collapsible pole assembly 210 includes a releasable lock assembly 230 that is configured to selectively lock the collapsible pole assembly 10 in an extended position. The releasable lock assembly 230 is substantially identical to the releasable lock assembly 30 described above. However, in this embodiment, the releasable lock assembly 230 extends between the first shaft section 214 and the third shaft section 222 (or handle mounting device 44).

Figure 9:
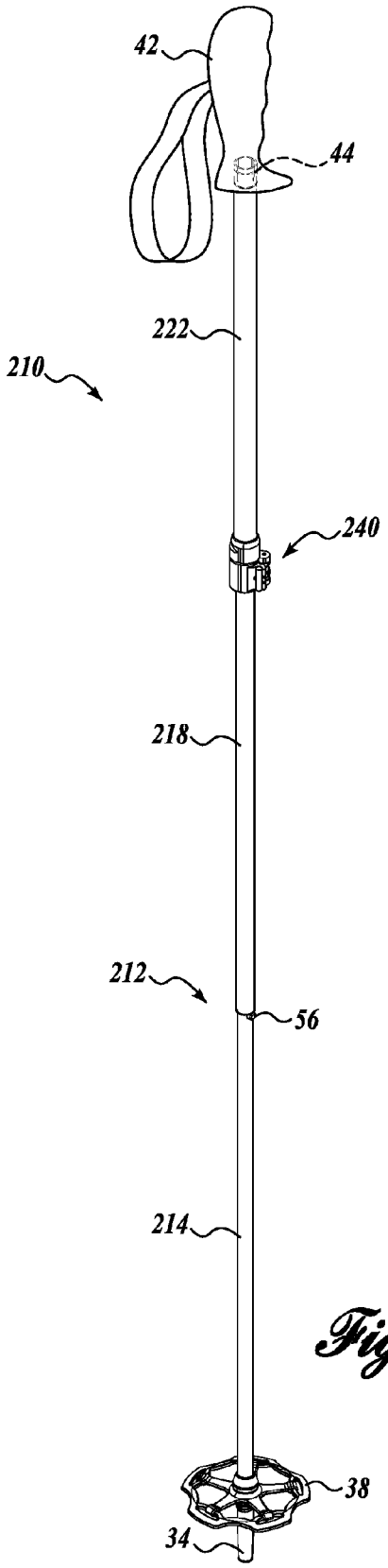
FIG. 9 is an isometric view of an exemplary collapsible pole assembly formed in accordance with a second aspect of the present disclosure; wherein the collapsible pole assembly is shown in an extended position.
Figure 10:
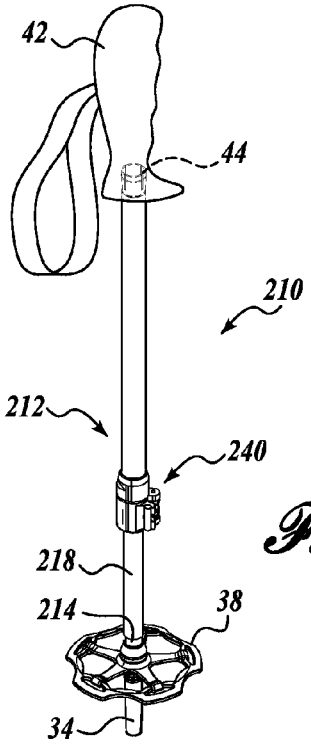
FIG. 10 is an isometric view of the collapsible pole assembly of FIG. 9 shown in a collapsed position.
Figure 11:
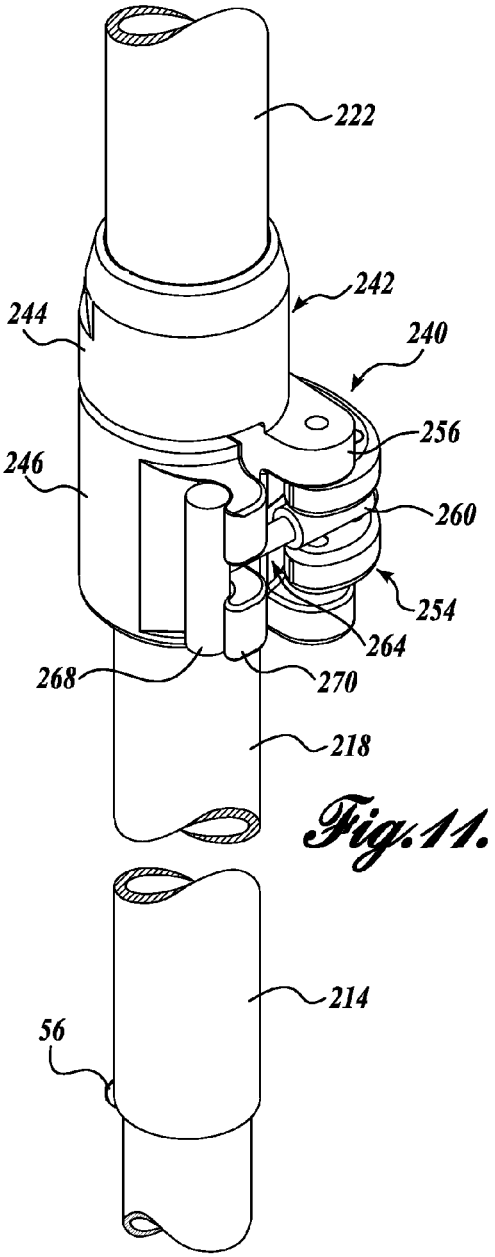
FIG. 11 is a rear isometric view of a collar assembly for use with the collapsible pole assembly of FIG. 9.
Figure 12:
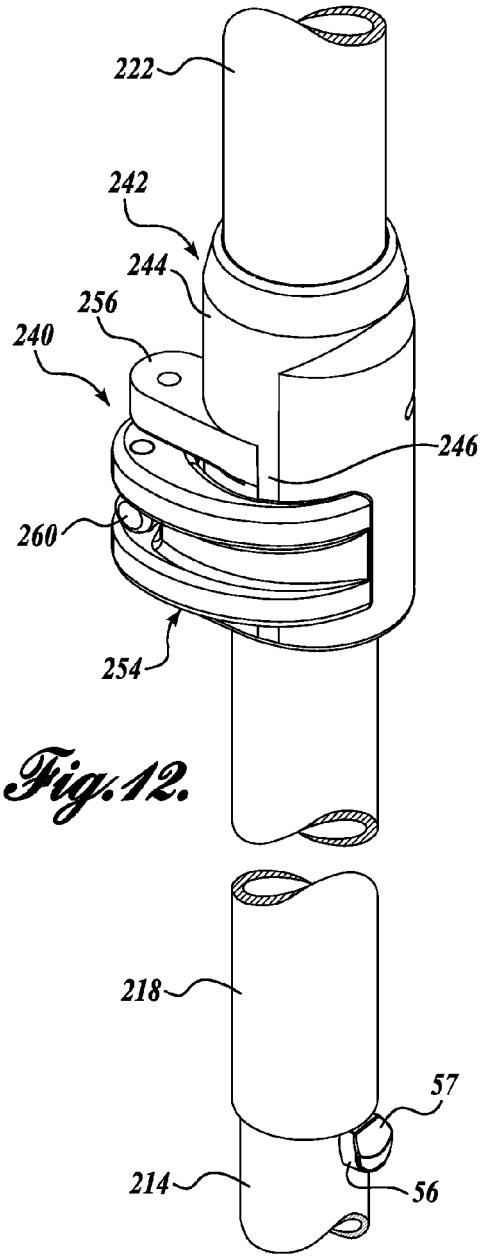
FIG. 12 is a front isometric view of the collar assembly of FIG. 11.

As with the releasable lock assembly 30, the releasable lock assembly 230 includes an expansion assembly 60 with the cylindrical shaft 50 secured within an upper end of the first shaft section 214 and the locking mechanism or detent mechanism 48 defined at the lower end of the cylindrical shaft 50. The spring pin 56 of the detent mechanism 48 is configured to engage a bottom edge of the second shaft section 218 when the second shaft section 218 is moved into an extended position, as shown in FIG. 9. Thus, the spring pin 56 secures the second shaft section 218 in the extended position.

The pin 66 of the pin assembly 64 is secured to the third shaft section 222 (or handle mounting device 44) through the first cord 94. As such, when the second shaft section 218 is extended, the cord 94 pulls axially, upwardly on the pin 64 to compress the compression spring 78 thereby securing the first and second shaft sections 214 and 218 together in tension. Moreover, with the first and second shaft sections 214 and 218 held together in tension, the first and second shaft sections 214 and 218 are urged into the collapsed position when the spring pin 56 is depressed.

Referring to FIGS. 11-15, the releasable lock assembly 230 further includes a collar assembly 240 secured to a lower end of the third shaft section 222 that is configured to selectively secure the third shaft section 22 in an extended position. The collar assembly 240 includes a substantially cylindrical body 242 having a hollow interior for receiving the second and third shaft sections 218 and 222. The body 242 includes an upper shaft securing portion 244 secured to the third shaft section 222 and a lower clamping portion 246 securable to the second shaft section 218.

The upper shaft securing portion 244 includes an interior diameter substantially equal to the outer diameter of the third shaft section 222 such that a friction fit or press fit is defined between the upper shaft securing portion 244 and the third shaft section. Additional fasteners, such as adhesive, may also be used to secure the upper shaft securing portion 244 to the third shaft section 222.

The lower clamping portion 246 includes an interior diameter substantially equal to or slightly larger than the outer diameter of the second shaft section 218 such that the second shaft section 218 is slidable relative to the lower clamping portion 246. A clamp assembly 250 is defined on the exterior surface of the lower clamping portion 246 for transitioning the lower clamping portion 246 between an open, unlocked position (see FIG. 13) having a first interior diameter, and a closed locked position (see FIG. 14) having a second interior diameter. In the closed, locked position, the interior diameter of the lower clamping portion 246 is sufficiently small to compress onto the second shaft section 218 to prevent the second shaft section 218 from sliding relative thereto.

Any suitable clamping assembly may be used to transition the lower clamping portion 246 between the unlocked and locked positions. Thus, the clamp assembly 250 will only be briefly described in detail. The clamp assembly 250 includes a lever arm 254 pivotally secured at a first, proximal end to a lever arm base 256 defined on the exterior surface of the lower clamping portion 246. Along the same pivot axis, the first, proximal end of the lever arm 254 is pivotally secured to a first end 260 of a clamp pin 264.

The clamp pin 264 extends substantially tangentially across the exterior of the lower clamping portion 246, and it is pivotally secured at its second end 268 within a pivot base 270 defined on the exterior surface of the lower clamping portion 246. The clamp pin 264 is configured to draw portions of the lower clamping portion 246 together to secure the lower clamping portion 246 in a locked position. In that regard, an axial slot 272 may extend along at least a portion of the lower clamping portion 246 between the lever arm base 256 and the pivot base 270. As such, the portions of lower clamping portion 246 on opposite sides of the axial slot 272 may be drawn together into a closed, locked position to secure the second shaft section 218 in an extended position.

Figure 13:
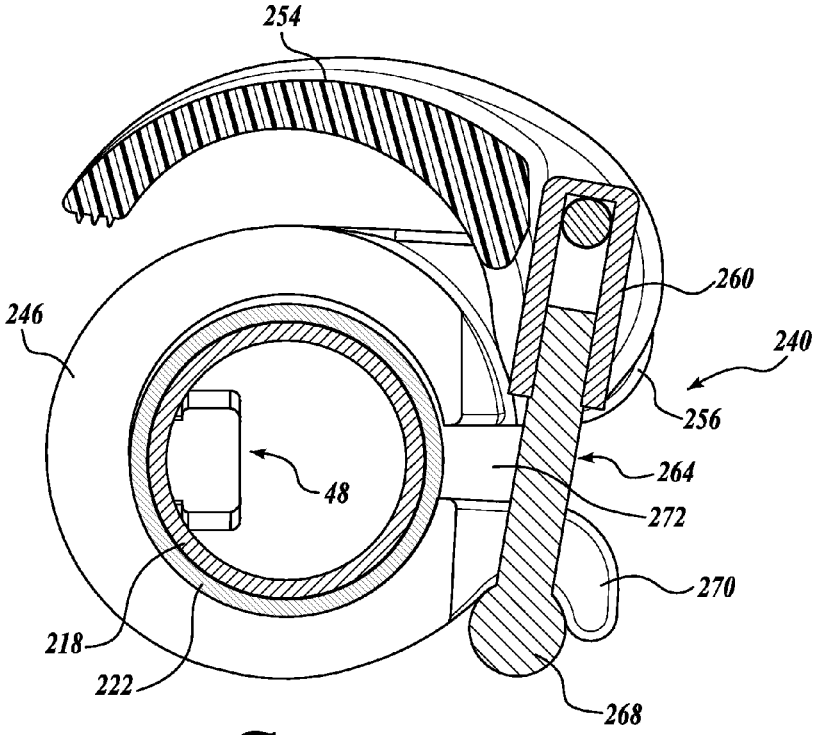
FIG. 13 is a cross-sectional view of the collar assembly of FIG. 11, wherein the collar assembly is shown in a first position.
Figure 14:
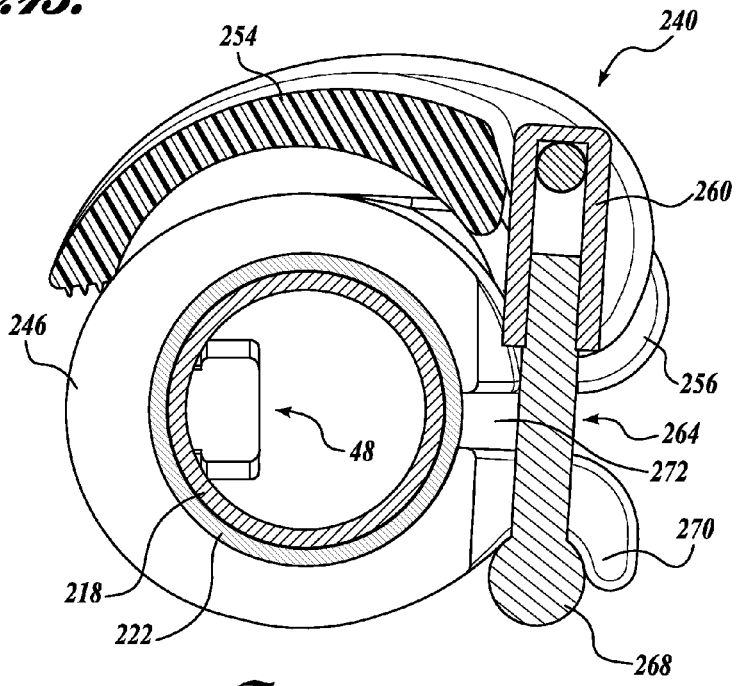
FIG. 14 is a cross sectional-view of the collar assembly of FIG. 11, wherein the collar assembly is shown in a second position.

The lever arm 254 may be moved between an open, unlocked position, as shown in FIG. 13, and a closed, locked position, as shown in FIG. 14. Referring to FIG. 13, the distal, second end of the lever arm 254 is moved away from the lower clamping portion 24, causing the clamp pin 264 to loosen its grip on the lower clamping portion 246. As such, the axial slot 272 widens and the interior diameter of the lower clamping portion 246 enlarges, allowing the second shaft section 218 to slide relative thereto.

Referring to FIG. 14, the distal, second end of the lever arm 254 is moved towards the lower clamping portion 24, causing the clamp pin 264 to tighten its grip on the lower clamping portion 246. As such, the axial slot 272 is decreased and the interior diameter of the lower clamping portion 246 decreases, preventing the second shaft section 218 from sliding relative thereto.

Thus, the clamp assembly 240 is moved into the open, unlocked position to allow the second shaft section 218 to move into one of the collapsed or extended positions, and the clamp assembly 240 is moved into the closed, locked position to secure the second shaft section 218 in the extended position. Moreover, with the releasable lock assembly 230 extending between the first and third shaft sections 214 and 222, the first, second, and third shaft sections 214, 218, and 222 are held in tension when extended.

The collar assembly 240 is also configured to automatically unlock the locking mechanism 48 when the third shaft section 222 is collapsed to further allow the second shaft section 218 to collapse. In that regard, the collar assembly 240 includes an interior annular clamp base angled surface 274 defined on a lower, interior edge of the lower clamping portion 246. The interior annular clamp base angled surface 274 extends from the lower interior edge of the clamping portion 246 inwardly toward the central, longitudinal axis of the lower clamping portion 246.

The interior annular clamp base angled surface 274 is slidable against a correspondingly angled pin surface 57 defined on the upper, outer edge of the spring pin 56. The angled pin surface 57 extends from an upper surface of the spring pin 56 downwardly toward a transverse end surface of the spring pin 56. In this manner, when the interior annular clamp base angled surface 274 engages and slides against the angled pin surface 57, the spring pin 56 is moved axially into the cavity 62 into the depressed position. With the spring pin 56 in the depressed position, the second shaft section 218 may slide relative to the first shaft section 214 into the collapsed position.

Thus, it can be appreciated that the collar assembly 240 automatically depresses the spring pin 56 of the locking mechanism when the third shaft section 222 is collapsed to further allow the second shaft section 218 to collapse. In this manner, the user does not need to depress the spring pin 56 by hand. With the first, second, and third shaft sections 214, 218, and 222 held together in tension, a user's finger can become pinched between the first and second shaft sections 214 and 218 when depressing the spring pin 56 by hand. Thus, the collar assembly 240 eliminates the extra step of depressing the spring pin 56 and eliminates the possibility of pinching a finger.

It should be appreciated that the collar assembly 240 may be used with a collapsible pole assembly having more than three shaft sections. For instance, if the collapsible pole assembly included a fourth shaft section collapsible within the first shaft section 214, an additional releasable lock assembly 230 with a detent mechanism 48 could be disposed between the fourth and first shaft sections. As such, the collar assembly 240 could be used to automatically depress the spring pins of both detent mechanisms 48 to allow the shaft sections of the pole assembly to collapse.

Moreover, the collar assembly 240 may instead be defined by a slidable ring or collar having an interior annular clamp base angled surface 274 that is engageable with the spring pin 56 when manually moving the ring. In such an alternative embodiment, the collapsible pole assembly would include an additional releasable lock assembly 230 with a detent mechanism 48 disposed between the second and third shaft sections 218 and 222. As such, the collar could first engage the spring pin disposed between the second and third shaft sections 218 and 222, thereby allowing the third shaft section 222 to collapse. Thereafter, with the third shaft section 222 collapsed, the collar could engage the spring pin disposed between the first and second shaft sections 214 and 218 to allow the second shaft section 218 to collapse.

It should further be appreciated that although the collar assembly 240 is shown and described with respect to a releasable lock assembly 230 that is substantially similar to the releasable lock assembly 30 described above, the collar assembly 240 may also be used with the releasable lock assembly 130 shown and described above with respect to FIGS. 7 and 8. Thus, it should be appreciated that any combination of the above-described features may be used without departing from the scope of the present disclosure.

While the preferred embodiment of the present disclosure has been illustrated and described, it will be appreciated that various changes can be made therein without departing from the spirit and scope of the present disclosure.

The embodiments of the present disclosure in which an exclusive property or privilege is claimed are defined as follows:

1. A collapsible pole assembly, comprising:
a first shaft section;
a second shaft section telescopingly received on the first shaft section, wherein the first and second shaft sections are movable between an extended and a collapsed position;
a locking mechanism configured to selectively lock the second shaft section in the extended position, wherein the locking mechanism includes a detent member moveably disposed between an extended position, wherein the detent member is engageable with the second shaft section to secure the second shaft section in the extended position, and a retracted position; and
an expansion assembly arranged to prevent the first shaft section from continuing to slide axially upwardly away from the second shaft section when the first and second shaft sections are moved into the extended position, wherein the expansion assembly comprises a biasing member configured to urge the first and second shaft sections into the collapsed position, wherein the biasing member is configured to be at least partially biased when the detent member is in the extended position and engageable with the second shaft section when the second shaft section is in the extended position, wherein the expansion assembly further comprising an elongated member having first and second ends, the first end secured to one of the first and second shaft sections and the second end secured to the other of the first and second shaft sections, wherein the biasing member is disposed between the second end of the elongated member and the other of the first and second shaft sections.

2. The collapsible pole assembly of claim 1, wherein the elongated member is fixedly secured at its first end to one of the first and second shaft sections and the elongated member is moveably secured at its second end to the other of the first and second shaft sections.

3. The collapsible pole assembly of claim 1, wherein the elongated member is moveably secured at its first end to one of the first and second shaft sections and the elongated member is moveably secured at its second end to the other of the first and second shaft sections.

4. The collapsible pole assembly of claim 1, further comprising:
a third shaft section telescopingly received on the second shaft section, wherein the third and second shaft sections are movable between the extended and the collapsed position;
a second expansion assembly comprising:
an elongated member having first and second ends, the first end secured to the second shaft section and the second end secured to the third shaft section; and
a biasing member configured to urge the second and third shaft sections into the collapsed position; and
a collar assembly engageable with the detent member to disengage the detent member from the second shaft section and to allow the first and second shaft sections to move into the collapsed position, wherein the collar assembly comprises:
a clamp assembly configured to selectively secure the third shaft section in an extended position; and
a base having an interior annular angled surface that is slidable against an angled surface of the detent member to urge the detent member into the retracted position.

5. A collapsible pole assembly, comprising:
a first shaft section;
a second shaft section telescopingly received on the first shaft section, wherein the first and second shaft sections are movable between an extended and a collapsed position;
a locking mechanism configured to selectively lock the second shaft section in the extended position, wherein the locking mechanism includes a detent member moveably disposed between an extended position, wherein the detent member is engageable with the second shaft section to secure the second shaft section in the extended position, and a retracted position;
an expansion assembly arranged to prevent the first shaft section from continuing to slide axially upwardly away from the second shaft section when the first and second shaft sections are moved into the extended position, wherein the expansion assembly comprises a biasing member configured to urge the first and second shaft sections into the collapsed position, wherein the biasing member is configured to be at least partially biased when the detent member is in the extended position and engageable with the second shaft section when the second shaft section is in the extended position; and
a collar assembly engageable with the detent member to move the detent member into the retracted position for allowing the first and second shaft sections to move into the collapsed position.

6. The collapsible pole assembly of claim 5, wherein the expansion assembly further comprises an elongated member having first and second ends, the first end secured to one of the first and second shaft sections and the second end secured to the other of the first and second shaft sections, wherein the biasing member is disposed between the second end of the elongated member and the other of the first and second shaft sections.

7. The collapsible pole assembly of claim 6, wherein the elongated member is fixedly secured at its first end to one of the first and second shaft sections and the elongated member is moveably secured at its second end to the other of the first and second shaft sections.

8. The collapsible pole assembly of claim 6, wherein the elongated member is moveably secured at its first end to one of the first and second shaft sections and the elongated member is moveably secured at its second end to the other of the first and second shaft sections.

9. A collapsible pole assembly, comprising:

a first shaft section and a second shaft section, wherein a proximal side of the first shaft section is placed within a distal side of the second shaft section; and a releasable lock assembly, comprising:

a biasing member within the first shaft section, wherein a proximal side of the biasing member is stopped against a key at the proximal side of the first shaft section; and an elongated member, wherein a distal side of the elongated member is fixed to a distal side of the biasing member, and a proximal side of the elongated member is fixed to the second shaft section;

wherein the releasable lock assembly further comprises a lock assembly shaft fixed within the proximal side of the first shaft section, wherein the lock assembly shaft comprises a cavity wherein the biasing member resides; and wherein the lock assembly shaft further comprises a detent that moves transversely outward to engage the second shaft section.

10. The collapsible pole assembly of claim 9, wherein the pole assembly is at an extended length, the detent extends outward from the lock assembly shaft, and an edge at the distal side of the second shaft section rests on the detent.

* * * * *